United States Patent [19]

Ito et al.

[11] 4,280,841

[45] Jul. 28, 1981

[54] METHOD FOR MANUFACTURING A MECHANICAL SEAL RING

[75] Inventors: Hiroshi Ito, Dazaifu; Shigeya Sakaguchi, Fukuoka, both of Japan

[73] Assignee: Nippon Tungsten Co., Ltd., Fukuoka, Japan

[21] Appl. No.: 939,947

[22] Filed: Sep. 6, 1978

[30] Foreign Application Priority Data

Sep. 27, 1977 [JP] Japan ..... 52-116291
Sep. 27, 1977 [JP] Japan ..... 52-116493

[51] Int. Cl.[3] ..... B22F 5/00; B22F 3/00

[52] U.S. Cl. ..... 75/203; 75/204; 75/208 R

[58] Field of Search ..... 75/208 R, 203, 204

[56] References Cited

U.S. PATENT DOCUMENTS

| | | | |
|---|---|---|---|
| 2,696,652 | 12/1954 | Cronin | 75/208 R |
| 2,703,750 | 3/1955 | Cotter | 75/208 R |
| 2,833,638 | 5/1958 | Owen | 75/204 |
| 3,065,535 | 11/1962 | Crehan et al. | 228/122 |
| 3,373,003 | 3/1968 | Schreiner | 75/208 R |
| 3,444,613 | 5/1969 | Foerster | 228/122 |
| 3,733,667 | 5/1973 | Miyashita et al. | 75/204 |
| 4,140,170 | 2/1979 | Baum | 75/203 |

FOREIGN PATENT DOCUMENTS

| | | | |
|---|---|---|---|
| 221945 | 9/1972 | U.S.S.R. | 228/122 |

*Primary Examiner*—Brooks H. Hunt
*Attorney, Agent, or Firm*—Jordan and Hamburg

[57] ABSTRACT

This invention relates to the manufacture of a mechanical seal ring provided with a cemented carbide hardened layer or ring which is firmly bound to a substrate of a mechanical seal ring and is of sufficient hardness.

The method is substantially characterized by the use of Ni—P alloy as a binder between the cemented carbide layer and the substrate.

In the manufacturing process, after a presintered carbide compact made of hard carbide powder such as tungsten carbide powder is applied to a groove of the substrate, the Ni—P alloy in either paste form or compacted and sintered compact form is applied onto the presintered carbide compact and finally is sintered in a non-oxidizing furnace. In the above sintering process, Ni and P infiltrates and diffuses into the substrate and the presintered carbide compact whereby the cemented carbide hardened layer and the substrate can be firmly bound to each other due to the metallurgical bonding therebetween.

7 Claims, 3 Drawing Figures

METHOD FOR MANUFACTURING A MECHANICAL SEAL RING

BACKGROUND OF THE INVENTION

The present invention relates to a method for manufacturing a mechanical seal provided with a cemented carbide hardened ring.

In modern industrial fields, various types of mechanical seals have been developed and used to solve various kinds of problems related to sealing.

Such mechanical seals vary in shape corresponding to their function and construction. Furthermore, in terms of raw materials for mechanical seals, various combinations can be considered.

Plastics, hard rubber, carbon, Hastelloy, ceramics and cemented carbides are considered as materials for the mechanical seal.

Among the above-mentioned materials, cemented carbides have especially been used in combination with carbon rings since they have favorable mechanical properties and wear-resistant property. In manufacturing such rings conventionally, a cemented carbide ring of a carbide group is primarily produced by a powder metallurgy method. The product is then ground and soldered to the iron base alloy substrate and finally is ground and polished.

In the above conventional manufacturing method, the cemented carbide ring is primarily produced. Therefore, although the mechanical seal requires the cemented carbide layer of 1 mm thickness, the green compact for such cemented carbide must be more than 3 mm thick in view of the deformation during sintering and the margin of the sintered compact for grinding. Furthermore, after the cemented carbide ring is soldered to a groove of an iron base alloy substrate, the cemented carbide must be ground to a desired thickness. Accordingly, the yield rate of materials becomes extremely low in terms of raw material.

Furthermore, problems still remain unresolved in view of labor and cost for manufacturing, the adhesion strength of the soldering, and errosion.

It is an object of the present invention to provide a method for manufacturing a mechanical seal ring which can resolve the afore-mentioned problems.

It is another object of the present invention to provide a method for manufacturing a mechanical seal ring which can impart firm and strong metallurgical bonding between the cemented carbide hardened layer and the substrate.

It is still another object of the present invention to provide a method for manufacturing a mechanical seal which can readily provide the cemented carbide layer onto the groove of the substrate thereby considerably reducing the manufacturing cost.

DETAILED DESCRIPTION OF THE DISCLOSURE

Figure 1:
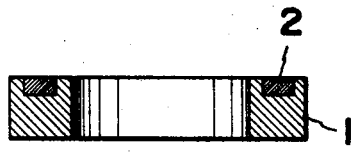
FIG. 1 is a cross sectional view of the mechanical seal.

The method of this invention is described hereinafter in view of following two embodiment.

Hereinafter, the compositions in this specification are expressed in terms of % by weight unless otherwise specified.

FIRST EMBODIMENT

In summary, the present embodiment is directed to a method of manufacturing a mechanical seal with a cemented carbide ring which has following processes. A hard carbide powder which is a single carbide selected from the group consisting of tungsten carbide, titanium carbide and tantalum carbide or a mixture thereof and composed of any number or any selection from such carbide group is packed in a groove formed on an iron base alloy ring, and then is compressed and molded. Up to 10% of the single carbide powder or the carbide mixture powder can have substituted therefor the corresponding percent of an iron group metal powder. The molded hard carbide powder compact is presintered in a non-oxidizing atmosphere. A paste which is a mixture of a nickel-phosphorus the (phosphorus amount is 8 to 13 percent) alloy powder and an organic binder is coated or sprayed onto the presintered compact. The applying of the nickel-phosphorus alloy to the presintered carbide compact can be conducted in other ways. For example, the nickel-phosphorus alloy powder may be first compacted and molded to form a ring-like alloy compact, and the alloy compact then presintered. The presintered alloy compact is placed on the presintered carbide compact, and finally the alloy-applied presintered compact is heated to a temperature of 1000° C. to 1100° C. in a non-oxidizing atmosphere.

The present embodiment is also directed to a method for manufacturing a mechanical seal with a cemented carbide ring which has the following processes. A hard carbide powder which is a single carbide selected from the group consisting of tungsten carbide, titanium carbide or tantalum carbide or a mixture there composed of any number or any selection from such carbide group powder is compacted and molded into a shape which corresponds to the shape of a groove formed in an iron base alloy ring. Up to 10% of the single carbide powder or the carbide mixture powder can have substituted therefor the corresponding percent of an iron group metal powder. The mold is then presintered in a non-oxidizing atmosphere and the presintered carbide compact is snugly placed into the groove of the substrate. A paste which is a mixture of nickel-phosphorus (the phosphorus is 8 to 13 percent) alloy powder and an organic binder is coated or sprayed onto the presintered carbide compact. The applying of the nickel-phosphorus alloy to the presintered carbide compact can be conducted in other ways. For example, the nickel-phosphorus alloy powder maybe is first compacted and molded to form a ring-like alloy compact. The alloy compact is then presintered and the presintered alloy compact is placed on the presintered carbide compact. Finally, the alloy-applied presintered carbide compact is heated at a temperature of 1000° C. to 1100° C. in a non-oxidizing atmosphere.

In the above method, the hard carbide powder includes materials commonly employed in the manufacture of cemented carbides such as tungsten carbide, titanium carbide or tantalum carbide. In general, such materials belong to Group 4B, Group 5B or Group 6B of the periodic table. Also in selecting a suitable iron group metal which is used as a binder in the present invention, the manner of selection in the manufacture of cemented carbide is applicable. Namely, it is generally known that when the carbide is titanium carbide, Ni mixed with a suitable amount of Mo addition is generally used since Ni, when used alone, shows poor wettability.

Due to the reasons set forth above, the iron group metal in the present invention is employed strictly as a binder which improves the compactibility of the carbide. Therefore, when the carbide is TiC, Ni which is an iron group metal can be used along with a suitable Mo addition.

The maximum amount of iron group metal (nickel, cobalt or iron) powder to be added amounts to 10 percent in this embodiment. Such determination of the iron group metal amount is based on the fact that when the amount is less than 10 percent, coupled with the effect of the nickel-phosphorus alloy which melts and diffuses, the cemented carbide hardened layer of the mechanical seal can increase the hardness thereof more than Hv 600 (Vicker's hardness) and such layer shows improved wear resistance.

Nickel, cobalt or iron powder is added to improve the compactibility of the hard carbide powder and thereby improves the presinterability thereof.

The amount of phosphorus in the nickel-phosphorus alloy accounts for 8 to 13 percent. Such determination of the range of phosphorus amount is based on the fact that, as can be observed from a Ni—P phase diagram, the alloy shows its low melting point (880° C. to 980° C.) when the phosphorus amount is in the above range. Therefore, the infiltration and diffusion of the alloy in the liquid phase is favorably effected.

The method of this embodiment is further explained in view of the following experiments.

(First Experiment)

Tungsten carbide powder mixed with an addition of 6.5 percent of cobalt powder (such composition is designated WC-6.5 Co hereinafter) was packed in a groove formed on a stainless steel (SUS 403) substrate and subsequently was compressed and molded under a pressure of 1000 kg/cm$^2$ to produce a green compact. Such green compact was heated in a vacuum furnace along with the substrate at a temperature of 1100° C. for 30 minutes producing a presintered layer of little shrinkage in the groove of the substrate. At this stage, the thickness of the presintered carbide layer was 1.3 mm. Then a paste which was produced by mixing methyl alcohol and water to methyl cellulose and nickel-phosphorus (phosphorus amount: 8 to 13 percent by weight) alloy powder was coated on the presintered carbide layer. After drying, the presintered carbide layer was heated in a vacuum furnace at 1100° C. for 30 minutes so that the nickel-phosphorus alloy could infiltrate and diffuse in the WC-6.5 Co presintered carbide layer. The cemented carbide hardened layer obtained in the above process showed firm and strong bonding with the substrate under diffusion-bonding effect. Finally, the cemented carbide compact layer was ground and polished to produce a finished product (mechanical seal) of a desired size.

The hardened layer had a hardness of Hv 170 (Vicker's hardness) and the thickness thereof was 1 mm.

FIG. 1 shows a cross sectional view of a mechanical seal obtained by the method of this invention wherein numeral 1 indicates a stainless steel substrate and numeral 2 indicates a cemented carbide hardened layer.

Figure 2:
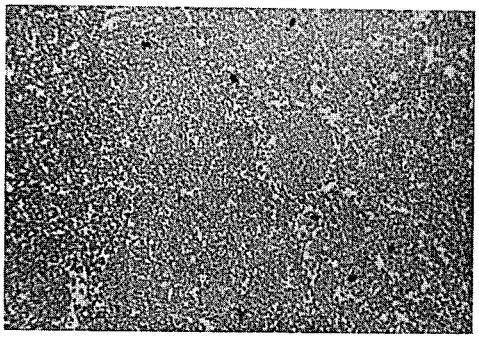
FIG. 2 is a photomicrograph of the cemented carbide hardened layer produced in the first experiment of the first embodiment.

FIG. 2 shows a photomicrograph of the inner structure of the hardened layer. As can be observed from FIG. 2, the hardened layer has a favorable inner structure, namely a uniform and non-porous structure.

(Second Experiment)

As in the case of the first experiment, a powder mixture consisting of 90 percent of titanium carbide, 8.5 percent of nickel and 1.5 percent of molybdenum (such composition is designated 90TiC—8.5Ni—1.5Mo hereinafter) was packed in a groove of a stainless steel substrate and subsequently was compressed and molded under a pressure of 1000 kg/cm$^2$ to form a green compact on the substrate. Such green compact was heated in a vacuum furnace along with the substrate at a temperature of 1100° C. for 30 minutes to produce a presintered carbide layer.

A nickel-phosphorus alloy paste then was coated on the presintered carbide layer. After drying, the presintered carbide layer was heated in a vacuum furnace at a temperature of 1100° C. for 30 minutes so that the nickel-phosphorus alloy could infiltrate and diffuse into the 90TiC—8.5Ni—1.5Mo presintered carbide layer. The thus obtained sintered compact was ground and polished to produce a finished product (mechanical seal) of a desired size.

In the analysis of the finished product, the hardened layer and the substrate were firmly bound to each other and the hardness of the hardened layer was Hv 600 (Vicker's hardness).

(Third Experiment)

A powder mixture of 84 percent of tungsten carbide, 3 percent of titanium carbide, 7 percent of tantalum carbide and 6 percent of cobalt (such composition is designated 84 WC—3 TiC—7 TaC—6 Co hereinafter) was compacted in a mold which has a shape corresponding to a groove formed on an iron base alloy (nickel 48 percent-iron 58 percent) substrate producing a ring-like compressed carbide compact. The compacting pressure in the above molding was 1200 kg/cm$^2$.

The thus obtained compacted carbide ring was heated in a vacuum furnace at a temperature of 1150° C. for 30 minutes, producing a presintered carbide ring.

This 84 WC—3 Tic—7 TiC—6 Co presintered carbide ring was snugly placed in the groove of the 42 Ni—58 Fe alloy substrate. The nickel-phosphorus alloy paste employed in the first embodiment was coated on the presintered carbide ring. After drying, the presintered carbide ring was heated in a vacuum furnace at a temperature of 1080° C. for 30 minutes. Through this heating process, the Ni—P alloy paste infiltrated and diffused into the presintered compact and produced a 84 WC—3 Tic—7 TiC—6 Co cemented carbide ring which was firmly bound to the groove of the substrate by diffusion bonding effect.

The thus obtained sintered body ring was ground and polished to produce a finished product of a desired size. The slide surface of the sintered compact ring had a hardness of Hv 730 (Vicker's hardness) showing the improved wear resistance as the mechanical seal.

(Fourth Experiment)

A powder mixture consisting of 94 percent of tungsten carbide and 6 percent of cobalt (such composition is designated 94 TiC-6 Co hereinafter) was compacted and molded to form a ring-like carbide compact, the shape of which corresponds to the shape of a groove formed on a stainless steel substrate. The compacting pressure was 2000 kg/cm$^2$. Thus obtained carbide compact was heated in a vacuum furnace at a temperature of 1150° C. for 30 minutes to produce a presintered carbide compact. This 94 WC—6 Co ring-like presintered carbide compact was snugly placed in the groove of the stainless steel substrate. Subsequently or simultaneously, the nickel-phosphorus (phosphorus percent is 8 to 13 percent) alloy powder was compacted and molded to form an alloy compact. The alloy compact was then presintered to produce a presintered alloy compact. The thus produced presintered alloy compact was placed on the presintered carbide compact. Finally, the alloy-applied presintered carbide compact was heated in a vacuum furnace at a temperature of 1000° C. and under a pressure of 30 g/cm$^2$ for 30 minutes so that the nickel-phosphorus alloy could infiltrate and diffuse into the presintered carbide compact to provide the firm diffusion bonding of the 94 WC—6 Co cemented carbide compact (ring) to the groove of the substrate.

The thus obtained compact (hardened layer) was ground and polished to produce a finished product (mechanical seal) of a desired size.

The hardened layer showed a hardness of Hv 850 (Vicker's hardness) and the thickness thereof was 1 mm.

(Fifth Experiment)

As in the case of fourth embodiment, a powder mixture consisting of 84 percent of tungsten carbide, 3 percent of titanium carbide, 7 percent of tantalum carbide and 6 percent of cobalt (such composition is hereinafter designated as 84WC-3TiC-7TaC-6Co) was compacted and molded to form a ring-like carbide compact, the shape of which corresponds to the shape of a groove formed on a stainless steel substrate. The compacting pressure was 1200 kg/cm$^2$. The thus obtained carbide compact was heated in a vacuum furnace at a temperature of 1150° C. for 30 minutes to produce a presintered carbide compact. This 84WC-3TiC-7TaC-6Co presintered carbide compact was snugly placed in the groove of the substrate. Subsequently, the presintered alloy compact produced by the same manner as that of the fourth experiment was placed on the presintered carbide compact. Finally, the alloy-applied presintered carbide compact was heated in a vacuum furnace at a temperature of 1100° C. and under a pressure of 30 g/cm$^2$ for 30 minutes so that the nickel-phosphorus alloy could infiltrate and diffuse into the presintered carbide compact to provide the firm diffusion bonding of 84WC-3TiC-7TaC-6Co cemented carbide compact (ring) to the groove of the substrate.

The thus obtained sintered carbide compact was ground and polished to produce a finished product (mechanical seal) of a desired size. The hardened carbide layer was 1 mm thick and had a hardness of Hv 800 (Vicker's hardness). Such hardness proves the high wear resistance of the above hardened layer.

As has been described heretofore, the mechanical seal ring of this embodiment has the following advantages.

(1) Through the use of a nickel-phosphorus the (phosphorus amount is 8–13 percent by weight) alloy which has a low fusion point of approximately 900° C. and which has a great diffusion speed or rate to the metals of Groups 4a, 5a and 6a of the periodic table such as tungsten, and metal of Group 8 of the periodic table such as iron or nickel, the cemented carbide hardened layer and the substrate can be firmly and strongly bound to each other under metallurgical bonding.

(2) In the present method of this embodiment, the presintered carbide compact can be readily prepared such that carbide powder is directly compressed and molded into a groove formed on an iron base alloy substrate and then is presintered or the green compact of carbide powder which has the shape of the groove is first presintered and subsequently the presintered compact is placed into the groove of the iron base alloy substrate. Then the nickel-phosphorus alloy in either a paste form or a green compact form is applied onto the presintered carbide compact and then the compact is sintered causing the diffusion of Ni—P alloy into the iron base alloy substrate and carbide compact. Therefore, the method of this invention provides a considerably easy manufacturing process.

(3) Since the thickness of the carbide powder, when packed in the groove, can be close to the thickness of the cemented carbide hardened layer of the finished product, the yield rate of the material in terms of the raw material can be improved.

SECOND EMBODIMENT

In summary, the present embodiment is directed to a method for manufacturing a mechanical seal with a cemented carbide ring which has the following processes. A hard carbide powder which is a single carbide selected from a group consisting of tungsten carbide, titanium carbide or tantalum carbide or a mixture of such carbide powders and 10 to 40 percent of nickel-phosphorus (the phosphorus amount is 8 to 13 percent) alloy powder are mixed with each other along with an organic binder to produce a mixture in a paste form. The paste mixture is coated in a groove formed in an iron base alloy ring and is dried. After drying, the mixture along with the metal ring is heated in a nonoxidizing atmosphere at 800°0 to 900° C. to produce a presintered compact. The paste mixture is then coated on the thus produced presintered compact, and the paste-coated presintered compact is heated at 1000° to 1100° C. to obtain a cemented carbide layer. The cemented carbide layer is ground and polished to produce a mechanical seal with a desired cemented carbide ring. In the above method, the hard carbide includes materials commonly employed in the manufacture of cemented carbides such as tungsten carbide, titanium carbide or tantalum carbide. In general, such materials belong to Group 4a, Group 5a or Group 6a of the periodic table.

The present embodiment is also characterized by the utilization of the nickel-phosphorus alloy powder which has a low fusion point and which has a high diffusion velocity relative to the metals which belong to Group 4, 5 and 6 of the periodic table such as tungsten and the metals which belong to Group 8 of the periodic table.

In the method of this embodiment, such nickel-phosphorus alloy powder is mixed with the carbide of metal in a powder form which belongs to Group 4a, 5a or 6a of the periodic table and such mixture is formed into a paste.

Therefore, the method of this embodiment is very simple in its process. Furthermore, since the thickness of the carbide powder, when packed in the groove in a paste form, can be close as to the thickness of the cemented carbide hardened layer of the finished product, and the yield rate of material in terms of raw material can be considerably improved. Furthermore, since the bonding between the cemented carbide hardened layer and the iron base alloy metal substrate is effected by the diffusion bonding of the nickel-phosphorus alloy, a strong bonding strength is obtained. In addition, compared with copper soldering or silver soldering, the diffusion bonding of the nickel-phosphorus alloy shows a higher errosion resistance to acid.

In the method of this embodiment, the amount of hard carbide powder accounts for 60 to 90 percent. The reason for determining such range lies in that the amount of hard carbide powder should be more than 60 percent by weight to impart the hardness of more than Hv 600 (Vicker's hardness) to the cemented carbide ring for a mechanical seal and that the amount of nickel-phosphorus alloy should be more than 10 percent by weight to obtain the firm bonding and dense coating layer.

In this embodiment, the amount of phosphorus in the nickel-phosphorus alloy accounts for 8 to 13 percent by weight. The reason for determining such range lies in that, as can be observed from the Ni-P phase diagram, the melting point of the alloy is low (880° to 980° C.) when the phosphorus amount is in the above range, so that the infiltration and diffusion of alloy in the liquid phase is improved.

The method of this embodiment is further explained in view of the following experiments.

(First Experiment)

A powder mixture consisting of 70 percent of tungsten carbide and 30 percent of nickel-phosphorus alloy [hereinafter such composition is described 70WC—30-(Ni—P)] was mixed with a paste which was produced by adding methyl alcohol and water to methyl cellulose producing a 70WC—30(Ni—P) alloy paste. This paste was coated in a groove of a carbon steel substrate and was heated in a hydrogen atmosphere furnace at 850° C. for 30 minutes. Due to such heating, a sintered compact which had minute cracks by shrinkage and slightly diffused into the substrate was obtained. The above 70WC—30(Ni—P) alloy paste was then coated on the sintered compact and the coated sintered compact was heated in a hydrogen atmosphere furnace at 1100° C. for 30 minutes. Due to such heating, a cemented carbide hardened layer which had no cracks, which was firmly bounded with the substrate and which had the hardness of Hv 650 (Vicker's hardness) was obtained. The cemented carbide hardened layer was then ground and polished to produce a cemented carbide ring of desired size for a mechanical seal. The hardened layer was 0.9 mm thick.

Figure 3:
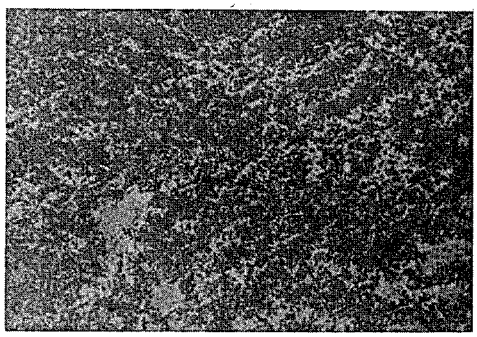
FIG. 3 is a photomicrograph of the cemented carbide hardened layer produced in the first experiment of the second embodiment.

FIG. 3 shows the photomicrograph of the hardened layer. As can be observed from FIG. 2, the hardened layer has a favorable inner structure, namely a uniform and non-porous structure.

(Second Experiment)

As in the case of first experiment, a paste, which was a mixture of 80 percent of titanium carbide and 3 percent of molybdenum and 17 percent of nickel-phosphorus alloy was produced. The paste was coated on a groove of a stainless steel substrate. Subsequently the paste on the substrate was processed in the same manner as that of the first experiment, namely, through the same heating and grinding processes of the first experiment. In the analysis of the finished product, the hardened layer and the substrate were firmly bound to each other and the hardness of the hardened layer was Hv 720 (Vicker's hardness).

(Third Experiment)

As in the case of the first experiment, a mixture consisting of 3 percent of titanium carbide, 7 percent of tantalum carbide and 90 percent of tungsten carbide was mixed with a nickel-phosphorus alloy powder at a mixing ratio of 80:20 (percent by weight) to form a paste mixture. The paste was coated in a groove of a 42 nickel—58 iron alloy substrate. Subsequently, the paste on the substrate was processed in the same manner as that of the first experiment, namely through the same heating and grinding processes of the first experiment. In the analysis of the finished product, the hardened layer which formed a slide sealing area of the mechanical seal had a hardness of Hv 750 (Vicker's hardness) which value is sufficient for a mechanical seal.

We claim:

1. A method of bonding a hard carbide powder material to an iron base alloy substrate to form a mechanical seal ring comprising:

(a) disposing a hard carbide powder material in a groove formed in an iron base alloy substrate, (b) compacting and presintering said hard carbide powder material while the latter is in said groove to form a presintered powder compact in said groove, (c) applying a separate bonding material in the form of a nickel-phosphorous alloy to said presintered powder compact, (d) heating said alloy-applied presintered powder compact in a non-oxidizing atmosphere to impart infiltration and diffusion of nickel and phosphorous from said bonding material into said iron base alloy substrate, and (e) metallurgically bonding said powder compact to said iron base alloy substrate by said infiltration and diffusion.

2. A method of bonding a hard carbide powder material to an iron base alloy substrate to form a mechanical seal ring comprising:

(a) compacting and presintering a hard carbide powder material into a presintered powder compact, (b) disposing said presintered powder compact in a groove formed in an iron base alloy substrate, (c) applying a separate bonding material in the form of a nickel-phosphorous alloy to said presintered powder compact, (d) heating said alloy-applied presintered powder compact in a non-oxidizing atmosphere to impart infiltration and diffusion of nickel and phosphorous from said bonding material into said iron base alloy substrate, and (e) metallurgically bonding said powder compact to said iron base alloy substrate by said infiltration and and diffusion.

3. A method according to claim 1 or 2 wherein said step of applying said nickel-phosphorous alloy comprises forming the nickel-phosphorous alloy as a paste by mixing the nickel-phosphorous alloy powder with an organic binder and applying said nickel-phosphorous paste onto said presintered carbide compact.

4. A method according to claim 1 or 2 wherein said step of applying said nickel-phosphorous alloy comprises molding a nickel-phosphorous alloy powder into an alloy green compact and disposing said alloy green compact on said presintered powder compact.

5. A method according to claim 1 or 2 wherein said hard carbide material comprises up to 10 percent of a binder selected from the group consisting of nickel, cobalt, and iron.

6. A method according to claim 1 or 2 wherein said carbide powder material comprises a metal carbide of a metal in Group 4b, 5b, or 6b of the periodic table, or mixtures thereof.

7. A method according to claim 1 or 2 wherein said carbide powder material comprises a carbide selected from the group consisting of tungsten carbide, titanium carbide, and tantalum carbide or mixtures thereof.

* * * * *